United States Patent [19]

Yamada

[11] Patent Number: 4,831,937

[45] Date of Patent: May 23, 1989

[54] AMUSEMENT RIDE DEVICE

[75] Inventor: Kazuo Yamada, Kawasaki, Japan

[73] Assignee: Togo Japan Inc., Tokyo, Japan

[21] Appl. No.: 131,672

[22] Filed: Dec. 11, 1987

[30] Foreign Application Priority Data

Dec. 15, 1986 [JP] Japan ..... 61-296802

[51] Int. Cl.[4] ..... A63G 21/04

[52] U.S. Cl. ..... 104/56; 104/81; 104/246

[58] Field of Search ..... 104/53, 56, 63, 67, 104/81, 91, 92, 94, 95, 100, 109, 246; 105/154, 155, 199.2

[56] References Cited

U.S. PATENT DOCUMENTS

| | | | |
|---|---|---|---|
| 814,939 | 3/1906 | Cerruti | 104/74 |
| 3,059,588 | 10/1962 | Chadenson | 104/94 |
| 3,889,605 | 6/1975 | Bacon | 104/56 |
| 3,941,060 | 3/1976 | Morsbach | 104/63 X |
| 4,170,943 | 10/1979 | Achrekar | 104/56 |
| 4,531,459 | 7/1985 | Yamada | 104/63 X |
| 4,548,136 | 10/1985 | Yamada | 105/91 |

FOREIGN PATENT DOCUMENTS

| | | | |
|---|---|---|---|
| 51-150435 | 12/1976 | Japan . | |
| 61-154690 | 7/1986 | Japan . | |
| 62-129071 | 6/1987 | Japan . | |
| 918203 | 4/1959 | United Kingdom | 104/94 |

*Primary Examiner*—Johnny D. Cherry
*Assistant Examiner*—Dean J. Kramer
*Attorney, Agent, or Firm*—Merchant, Gould, Smith, Edell, Welter & Schmidt

[57] ABSTRACT

An amusement ride device comprises a track composed of a pair of parallel rails and having a central axis extending between the rails, and a car adapted to travel along the track. The car includes a car body, a pair of front wheels and a pair of rear wheels adapted to be rotated in contact with the rails, thereby allowing the car body to travel along the rails, a swinging frame, having the rear wheels rotatably supported on each end thereof and extending substantially at right angles to the advancing direction of the car, and a bogie shaft attached to the car body so as to extend in the advancing direction of the car and pivotally supporting the swinging frame. The track includes a first straight section, a twist section continuous with the first straight section, at which the rails are twisted together at a predetermined angle to the central axis, a second straight section continuous with the twist section and having an overall length at least equal to that of the car, and an arcuate curve section continuous with the seocnd straight section, the respective central axes of the first and second straight sections and the twist section being substantially in line with one another.

12 Claims, 7 Drawing Sheets

AMUSEMENT RIDE DEVICE

BACKGROUND OF THE INVENTION

The present invention relates generally to and more particularly to cars adapted to be guided by a track for travel, amusement ride devices or systems, such as roller coasters, which are installed in parks, amusement parks, etc.

A device of this type has already been proposed by the inventor hereof (U.S. patent application Ser. No. 891,247, filed on July 29, 1986 now U.S. Pat. No. 4,724,771).

SUMMARY OF THE INVENTION

The object of the present invention is to provide an amusement ride device which can be used alone as an independent system, and which can also be combined with the track of a conventional amusement ride device or track. The present invention constitutes a system with a more sophisticated or thrilling course layout.

DETAILED DESCRIPTION OF THE PREFERRED EMBODIMENTS

Figure 1:
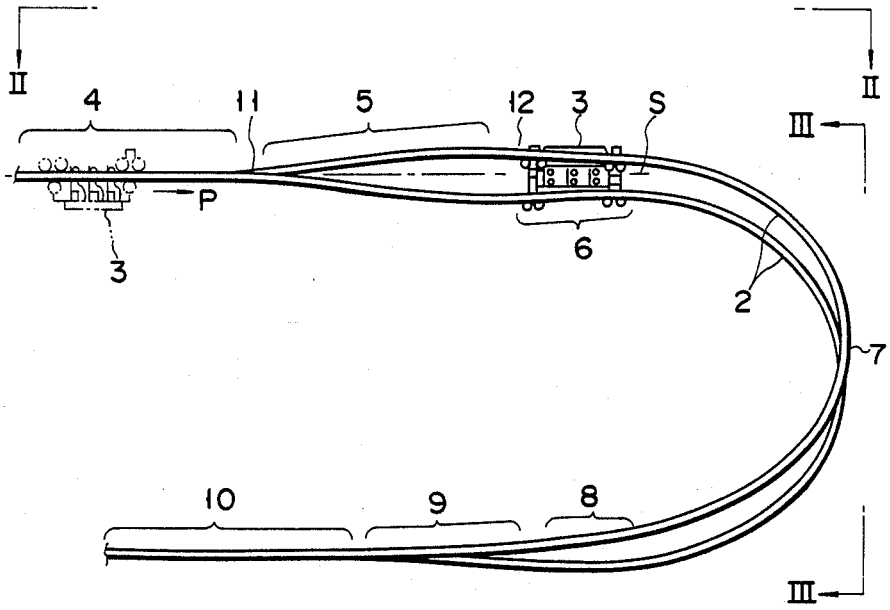
FIG. 1 is a side elevational view of a first embodiment of the present invention, showing an arrangement of a track.
Figure 2:
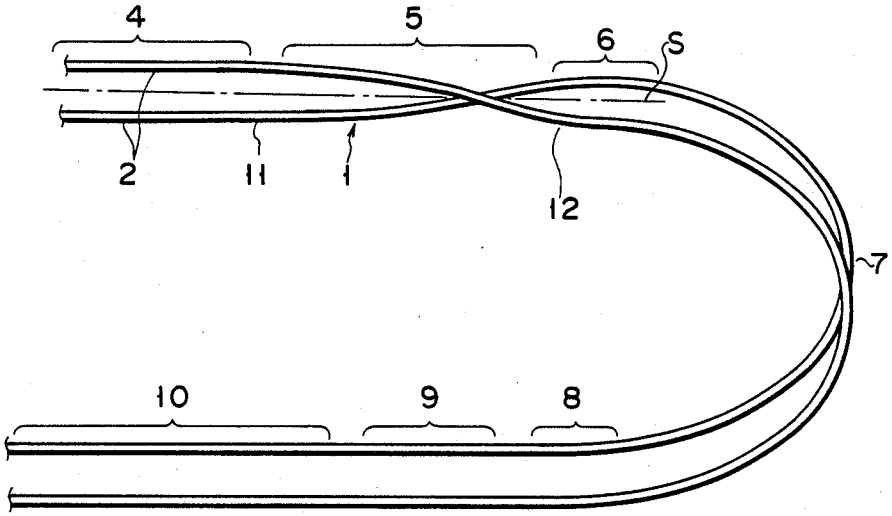
FIG. 2 is a schematic top view of the track from the side of line II—II of FIG. 1.

Referring now to FIGS. 1 to 9, a first embodiment of the present invention will be described. In these drawings, numeral 1 designates a track, which is composed of a pair of rails 2 extending at a uniform distance from each other. Numeral 3 designates a car, whose construction will be described later.

Track 1 includes a first straight section 4, a first twist section 5 twisted clockwise at 135° with respect to the advancing direction, a second straight section 6, a parallel curve section 7, a third straight section 8, a second twist section 9, and a fourth straight section 10, arranged continuously in the order named.

In the first straight section 4, rails 2 extend within the same plane, and car 3, indicated by a broken line, can travel straight ahead in the direction of arrow P, kept substantially in a horizontal posture with respect to all directions.

In the first twist section 5, which extends from the rear end of first straight section 4, rails 2 are twisted clockwise at 135°, with respect to the advancing direction.

In the second straight section 6, rails 2 extend parallel to each other as they are kept twisted together at 135°. Section 6 has a length substantially equal to or greater than that of car 3. The respective central axes (center lines between the rails) of sections 4, 5 and 6 are substantially in line with one another.

Figure 3:
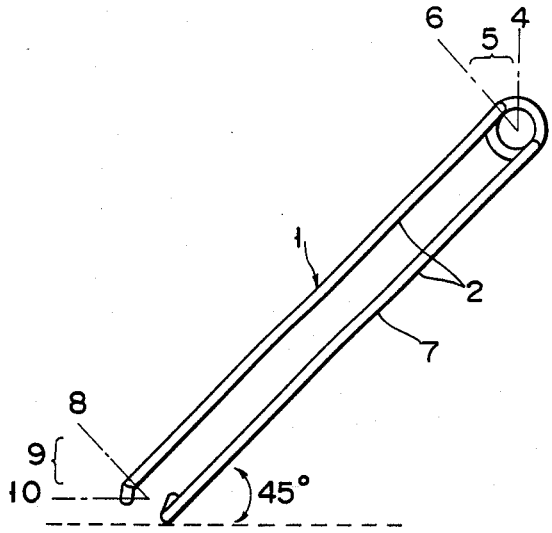
FIG. 3 is a schematic front elevational view of the track from the side of line III—III of FIG. 1.

In the parallel curve section 7, rails 2 are curved through approximately 180° in a parallel relation such that they are kept twisted together at 135° and there is no difference in the radius of curvature between them. Thus, the rails in this section form parallel curves which look like a curved belt without a twist. As shown in FIG. 3, section 7 is inclined at an angle of approximately 45° to a horizontal plane.

In the third straight section 8, which is continuous with parallel curve section 7, the central axis of rails 2 extends horizontally. Section 8 has a length substantially equal to or greater than that of car 3.

In second twist section 9, which is continuous with the third straight section 8, rails 2 are twisted at 45°.

In the fourth straight section 10, rails 2 extend horizontally parallel to each other, and car 3, after having passed the second twist section 9, can travel straight ahead, kept substantially in a horizontal posture with respect to all directions.

FIGS. 4 to 8 show the construction of car 3 which is adapted to travel on track 1 arranged in this manner.

Figure 4:
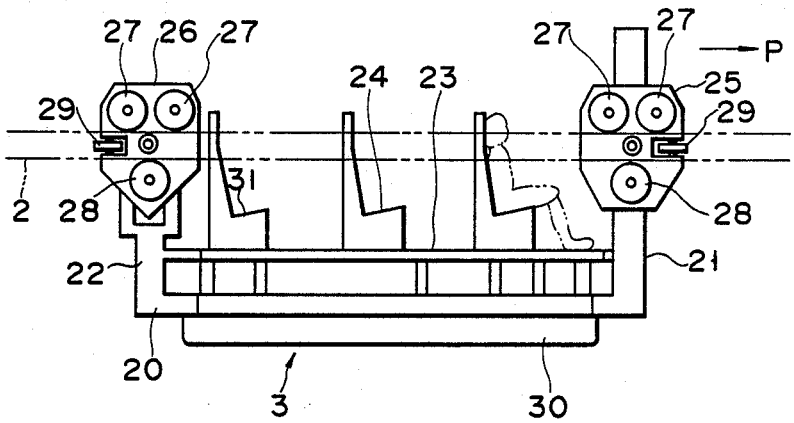
FIG. 4 is a side elevational view showing a car adapted to travel on the track according to the present invention.
Figure 5:
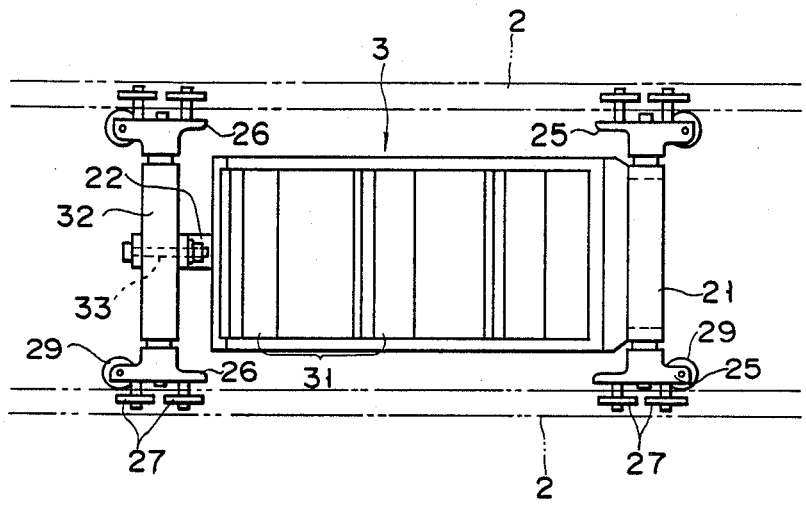
FIG. 5 is a plan view of the car shown in FIG. 4.

FIGS. 4 and 5 are a side view and a plan view, respectively, of the car. Referring to these drawings, there are shown rectangular chassis 20, front frame 21 integrally fixed to chassis 20, rear post portion 22 protruding vertically from the center of chassis 20, bottom plate 23 of the car, and seat frame 24. These components constitute the body of the car. Numerals 25 and 26 designate front and rear wheel mounting frames, respectively. Each of the wheel mounting frames is fitted with a pair of main wheels 27, anchor wheel 28, and side wheel 29. The paired main wheels are adapted to rotate in contact with one side of their corresponding rail 2. Anchor wheel 28 is located at a distance equal to the rail width from the main wheels, to rotate in contact with the opposite side of rail 2. Side wheel 29 has an axis of rotation extending at right angles to those of wheels 27 and 28 to be contacted with the lateral side of rail 2.

Numeral 30 designates a brake plate which is fixed to the underside of chassis 20. Plate 30 is adapted to be held between brakes fixed on a platform, thereby frictionally stopping the car, when the car is braked at the platform or the like.

Arrow P indicates the advancing direction of the car. Numeral 31 designates a seat on the car 3. While the car is running, each passenger sitting on seat 31 is held in place by means of a body retainer (not shown) so as to keep his body in the seat 31.

Figure 6:
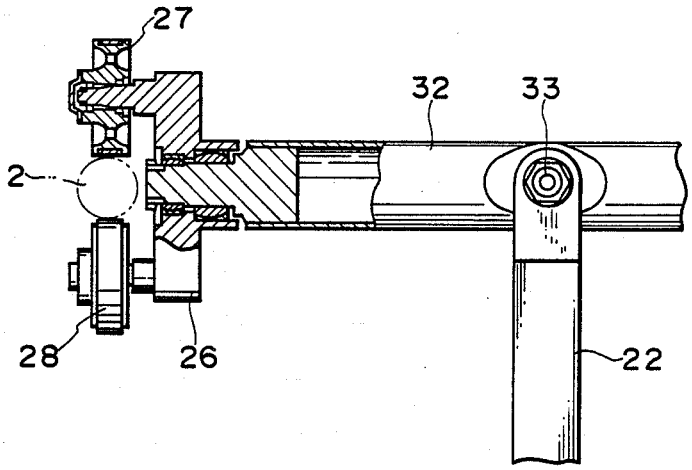
FIG. 6 is an enlarged view, partially in section, showing a rear frame portion of the car shown in FIG. 4.
Figure 7:
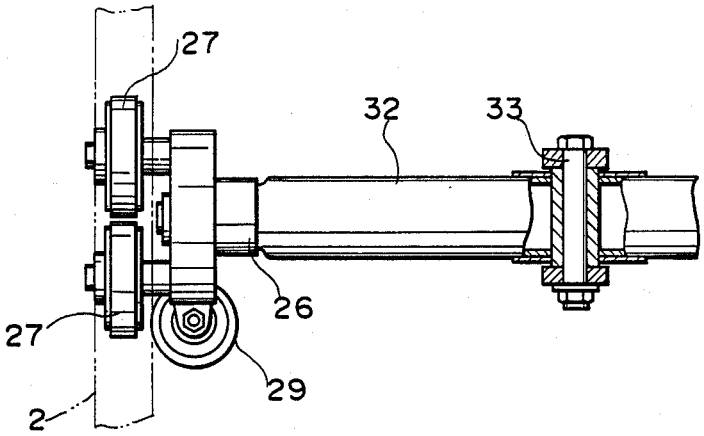
FIG. 7 is a plan view of the rear frame portion shown in FIG. 6.

Numerals 32 and 33 designate a rear cross frame and a bogie shaft, respectively. Frame 32 is situated on the rear side of the car body, and is freely penetrated by shaft 33. Also, frame 32 is coupled to rear post portion 22 of chassis 20 by means of shaft 33 so as to be rockable around the shaft. The central axis of bogie shaft 33 passes through along a center line between two rails 2, extending in the longitudinal direction of the car or in the traveling direction. Rear wheel mounting frame 26 is mounted on each end of rear cross frame 32. Thus, frame 26 is swingable around shaft 33, within a plane perpendicular to the traveling direction of the car, and can follow up the twist of its corresponding rail, independently of the car body. FIGS. 6 and 7 show the detail of this arrangement.

Figure 8:
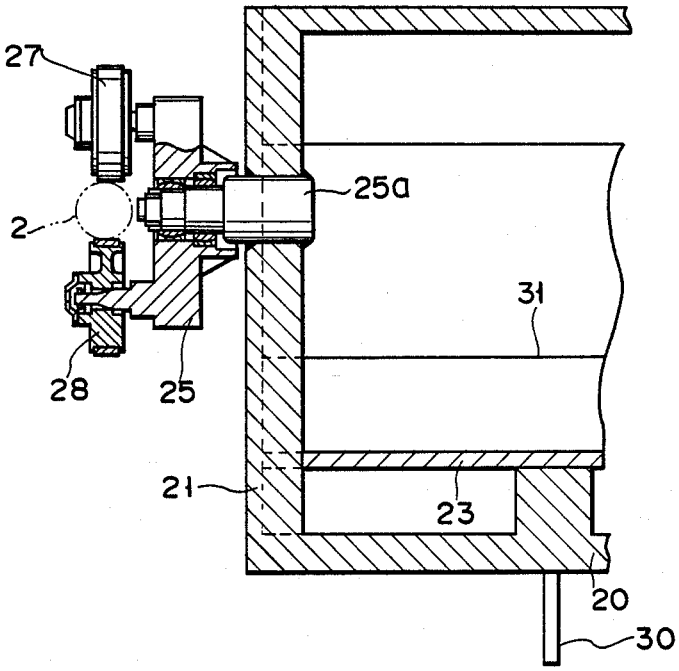
FIG. 8 is an enlarged view, partially in section, showing a front frame portion of the car shown in FIG. 4.
Figure 9:
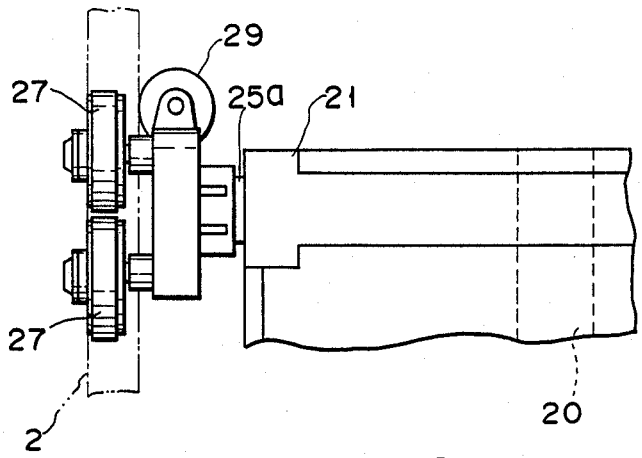
FIG. 9 is a plan view of the front frame portion shown in FIG. 8.

FIG. 8 is a sectional view showing the relative positions of part of front frame 21 of the car, front wheel mounting frame 25, main wheels 27, and anchor wheel 28. FIG. 9 is a plan view of the assembly shown in FIG. 8. Front frame 21 is fixed integrally to chassis 20. Shaft portion 25*a*, which serves as the center of rocking motion of mounting frame 25, is welded to front frame 21, thus constituting part of the front frame. Thus, when the wheels mounted on frame 25 follow up the twist of the rail, so does the car body.

The operation of the first embodiment, arranged in this manner, will now be described. In FIG. 1, car 3, indicated by a broken line on the left side of the drawing, is traveling horizontally in the direction of arrow P, along first straight section 4, in a manner such that passengers are seated with their head upward. Further along the track 1, car 3, indicated by an unbroken line on the right side of FIG. 1, travels along second straight section 6, after having been twistedly turned clockwise through 135°, with respect to the advancing direction, from the normal position for horizontal travel. In this state, the passengers are seated with their head obliquely downward.

Coming forward from the upper left of FIG. 1, car 3 starts to be twisted when it enters twist section 5 after having passed through first straight section 4. More specifically, at the boundary 11 between sections 4 and 5, rails 2 start to twist around the central axis between them. The rails are twisted clockwise at 90°, with respect to the advancing direction, at the middle portion of twist section 5. At the boundary 12 between section 5 and second straight section 6, the twist angle is 135°. Thus, the front wheels of car 3 are first twisted along twist section 5. As rear cross frame 32 is rockably coupled to chassis 20 by means of bogie shaft 33, which extends in the advancing direction, the rear wheels are twisted at twist section 5, after a delay behind the front wheels. Thus, car 3 is twisted at 135° when it reaches boundary 12 between sections 5 and 6. In this position, however, the rear wheels are in the middle of twist section 5, and have not finished being fully twisted through 135° yet.

While the car body is travelling at second straight section 6, the rear wheels substantially finish being twisted clockwise through 135°, with respect to the advancing direction, from the normal horizontal position. Thus, the whole car is kept inclined at 135° at section 6. To maintain such an inclination, section 6 must be at least substantially as long as car 3. In this arrangement, the car body and the front and rear wheels advance straight in a manner such that they are inclined clockwise, with respect to the advancing direction, at an entire angle of 135° to the normal horizontal position. Thus, the rear portion of car 3, as well as the front portion thereof, is inclined clockwise, with respect to the advancing direction, substantially at an angle 135° to the normal horizontal position.

Then, car 3 enters parallel curve section 7, where it travels downward along a path which is curved substantially in a semicircle. The plane defined by the trace of such travel is inclined at an angle of 45° to a horizontal plane. Thus, the car is reoriented so that it gets out of a vertical plane which contains first straight section 4.

When car 3 is traveling along the parallel curve of track section 7, the heads of pasengers are directed to the center of rotation. Even though the passengers are subjected to centrifugal force, they cannot fly out of the car 3.

When the car 3 reaches the third straight section 8, after having passed through parallel curve section 7, it advances straight through a distance longer than the car's length, and then enters second twist section 9. Since section 9 is twisted at 45°, car 3 is twistedly turned to resume the normal horizontal position in which the passengers are seated with their head upward.

Thereafter, car 3 enters fourth straight section 10, where it travels horizontally.

According to the first embodiment of the present invention, as described above, car 3 is redirected so as to get out a vertical plane containing first straight section 4, in the course of advancing from section 4, on the upper side, to fourth straight section 10, on the lower side. Thus, the course layout of track 1, is improved in the degree of freedom.

Figure 10:
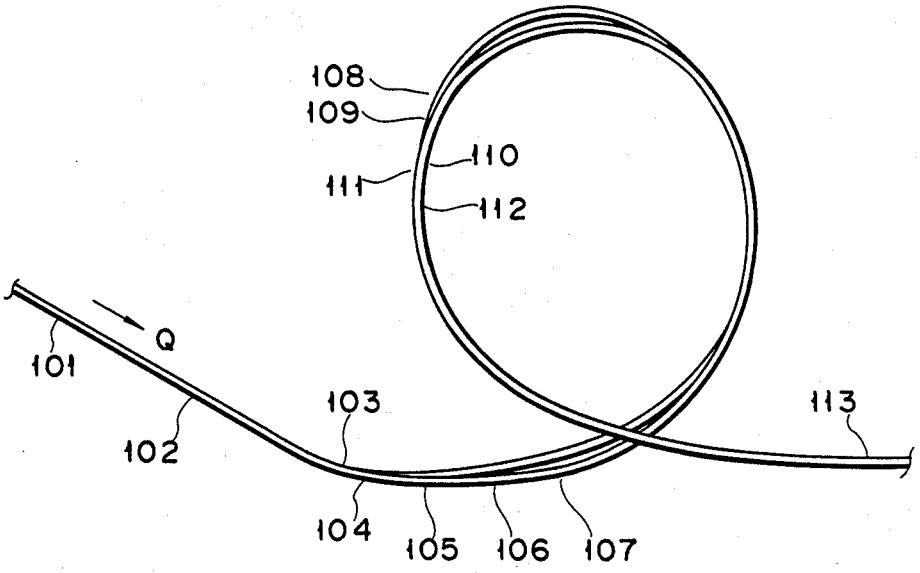
FIG. 10 is a side elevational view of a track according to a second embodiment of the invention.
Figure 11:
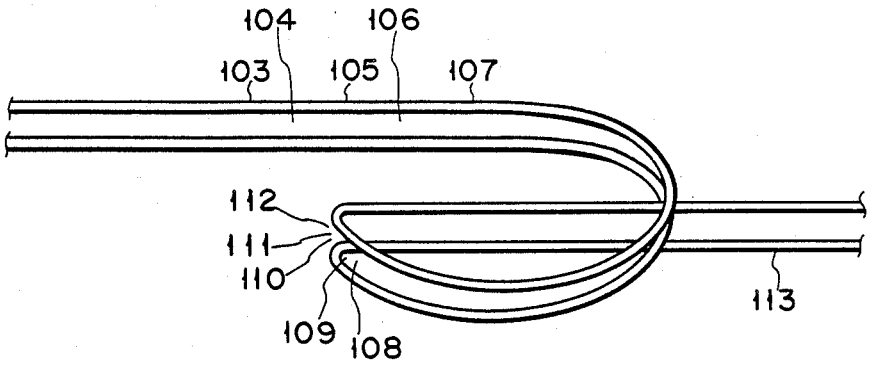
FIG. 11 is a plan view of the track shown in FIG. 10.
Figure 12:
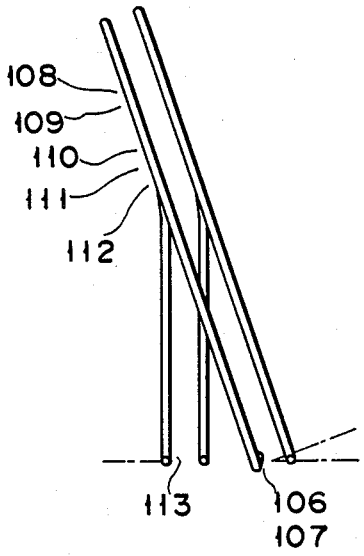
FIG. 12 is a front elevational view of the track shown in FIG. 10.

FIGS. 10 and 12 show a second embodiment of the present invention, in which FIG. 10 is a side view, FIG. 11 is a top view of a track shown in FIG. 10, and FIG. 12 is a front view of the arrangement shown in FIG. 10. In these drawings, numerals 101 and 102 designate a track and rails, respectively, and arrow Q indicates the traveling direction of a car (not shown). The car has the same construction as the one shown in FIGS. 4 to 9.

The car runs down from the upper left portion (not shown) of a straight slope section by a necessary inertia for course traveling. Then, the car makes a turn at point 103, thus entering first straight section 104 which extends horizontally. Immediately after the entrance into section 104, the car travels horizontally in a normal posture. When twist section 105 is reached, the track starts to be twisted with its central axis kept straight, providing for the travel of the car along a substantially circular, tilted track section in the next stage. When the car reaches second straight section 106, where it is tilted following the inclination of the tilted track section, it advances the point 107 through a straight track section having a length substantially equal to the car's length. Then, the car enters the circular tilted track section as a curve section. As seen from FIG. 12, the tilted track section is inclined at an angle of 20° to a vertical plane. The middle point between rails 102 at section or point 106 or 107 is on the extension of the central axis of first straight section 104. At section 106, the rails 102 cause the front frame 21 of the car to be tilted, as well as the bottom plate 23 which is integral with frame 21. At point 107, the tilted car can enter the circular tilted track section. In the vicinity of the peak point of the tilted track section, passengers in the car have their head and feet downward and upward, respectively, with an inclination of 20°. In this position, however, the body of each passenger, which is bound to the seat by means of a safety device, is urged against bottom plate 23 of the car by centrifugal force. Thus, the passengers are prevented from falling out of the car.

At point 108, beyond the peak point of the tilted track section, the center line between the two rails changes its substantially circular or curvature shape into a straight one. Then, the rails start to be twisted at point 109. Between points 109 and 110, the rails are twisted counterclockwise with respect to the advancing direction. After finishing being twisted at point 110, the rails extend straight at section 111, curve at section 112, and then form a normal horizontal track at section 113.

In the second embodiment shown in FIGS. 10 to 12, the track has two sections where the two rails are twisted around the center the center line between them. These are the sections between sections 105 and 106 and between points 109 and 110. Each of these sections is connected to a straight track section at each end.

Thus, the traveling direction of the car is turned at 180° and 360° in the first and second embodiments, respectively.

Figure 13:
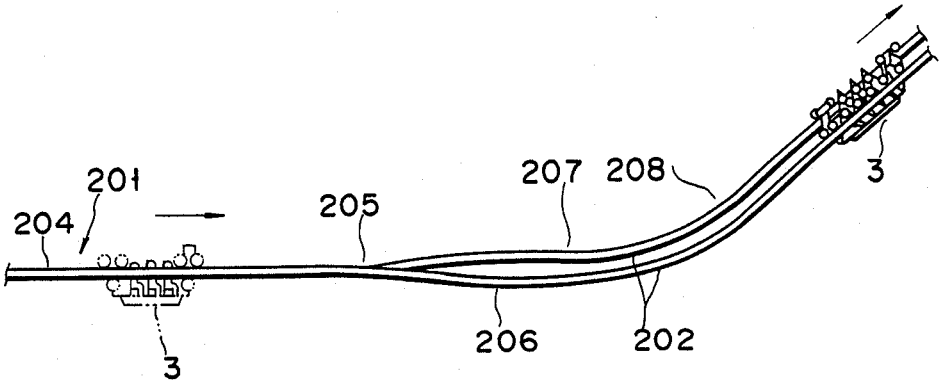
FIG. 13 is a side elevational view of a track according to a third embodiment of the invention.
Figure 14:
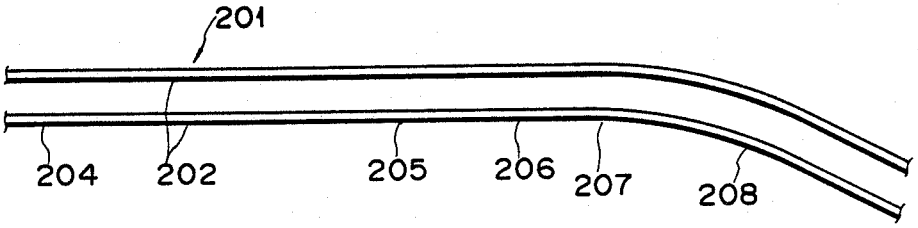
FIG. 14 is a plan view of the track shown in FIG. 13.
Figure 15:
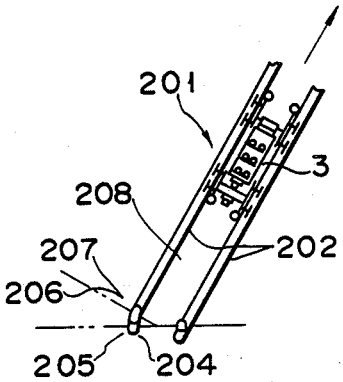
FIG. 15 is a rear elevational view of the track shown in FIG. 13.

FIGS. 13 to 15 show a third embodiment of the present invention, in which FIG. 13 is a side view, FIG. 14 is a top view of a track shown in FIG. 13, and FIG. 15 is a rear view of the arrangement shown in FIG. 13. In these drawings, numerals 201 and 202 designate a track and rails, respectively, and the arrow indicates the traveling direction of a car. The car 3 has the same construction as the one shown in FIGS. 4 to 9.

The car is in a normal horizontal posture when it travels in the direction of the arrow along first straight section 204. When twist section 206 is reached via boundary 205, the track 201 starts to be twisted with its central axis kept straight, providing for the travel of the car along a tilted track section as a parallel curve section in the next stage. When the car reaches second straight section 207, where it is tilted following the inclination of the tilted track section, it passes through section 207 which has a length substantially equal to its length. Then, the car enters tilted track section 208 at the parallel curve section. As seen from FIG. 15, section 208 is inclined at an angle of 20° to a vertical plane.

According to the present invention, the car of the aforementioned form may be run in other directions than those described above.

In the device or system described above, a pair of rails are used to form a first straight section, which is followed by a twist section in which the rails are twisted at a predetermined angle. The twist section is followed by a second straight section which has a length not shorter than that of the car. The second straight section is followed by a parallel curve section in which the rails have the same radius of curvature. Thus, the car, which has one bogie shaft with its central axis in line with the center line between the two rails of a straight track, can be transferred from an initial straight track section to another straight track section which is arranged in any direction in three dimensions.

Having no vertical bogie shaft, the car of this construction has a higher mechanical strength and a simpler structure than ones which have a vertical bogie shaft. Thus, the car according to the present invention is well adapted for nose-dive travel and twist travel. By combining the track according to the invention with conventional tracks, such as those for nose-dive travel, twist travel, etc., the most thrilling course layout can be obtained than has ever been experienced with conventional track layouts.

In the embodiments described above, the bogie shaft, which is used to swing the wheels within the plane perpendicular to the traveling direction, is mounted on the rear side of the car body, while the unswingable wheels are mounted on the front side. Alternatively, however, the bogie shaft and the unswingable wheels may be mounted on the rear and front sides, respectively. In this case, the car is expected to run to the left, as illustrated in FIG. 5.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described but to cover all modifications that may fall within the scope of the appended claims.

What is claimed is:

1. An amusement ride device, comprising:

(a) a track composed of first and second parallel rails and having a central axis extending between the rails, the track including a first straight section, a twist section continuous with the first straight section in which the rails are twisted together at a predetermined angle to the central axis, a second straight section continuous with the twist section and having an overall length at least equal to that of the car, and an arcuate curve section continuous with the second straight section, the respective central axes of the first and second straight sections and the twist section being substantially in line with one another;

(b) a car adapted to travel along the track, the car including a car body having a front end and a rear end, first and second pairs of first wheels and first and second pairs of second wheels, the pairs of wheels adapted to be rotated in contact with the rails, each pair of first wheels being longitudinally spaced from each pair of second wheels along the advancing direction of the car;

(c) supporting means for supporting the first and second pairs of first wheels so that the pairs of first wheels are swingable within a plane perpendicular to the advancing direction of the car, the supporting means including a swinging frame, the pairs of first wheels being rotatably supported on opposed ends thereof, the swinging frame extending substantially at right angles to the advancing direction of the car, the supporting means also including a coupling member for swingably mounting the frame on the car body, the coupling member including a bogie shaft attached to the car body so as to extend in the advancing direction of the car and pivotally support the swinging frame, wherein said bogie shaft is attached to the rear end of the car body, and said first and second pairs of second wheels are mounted on opposing sides of the front portion of the car body; and (d) retaining means for keeping the pairs of wheels in contact with the rails as the wheels rotate.

2. An amusement ride device, comprising:

(a) a track composed of first and second parallel rails and having a central axis extending between the rails, the track including a first straight section, a twist section continuous with the first straight section in which the rails are twisted together at a predetermined angle to the central axis, a second straight section continuous with the twist section and having an overall length at least equal to that of the car, and an arcuate curve section continuous with the second straight section, the respective central axes of the first and second straight sections and the twist section being substantially in line with one another;

(b) a car adapted to travel along the track, the car including a car body having a front end and a rear end, first and second pairs of first wheels and first and second pairs of second wheels, the pairs of wheels adapted to be rotated in contact with the rails, each pair of first wheels being longitudinally spaced from each pair of second wheels along the advancing direction of the car;

(c) supporting means for supporting the first and second pairs of first wheels so that the pairs of first wheels are swingable within a plane perpendicular to the advancing direction of the car, the supporting means including a swinging frame, the pairs of first wheels being rotatably supported on opposed ends thereof, the swinging frame extending substantially at right angles to the advancing direction of the car, the supporting means also including a coupling member for swingably mounting the frame on the car body; and (d) retaining means for keeping the pairs of wheels in contact with the rails as the wheels rotate, wherein said retaining means includes a first pair of first auxiliary wheels rotatably mounted on the swinging frame such that one of each first pair of first auxiliary wheels faces one of each first and second pair of first wheels, each said rail being held between each of the first and second pairs of first wheels and one wheel of the first pair of auxiliary wheels.

3. The amusement ride device according to claims 2, wherein said retaining means includes a second pair of first auxiliary wheels rotating mounted on the swinging frame, wherein each first auxiliary wheel of the second pair is at right angles to the first and second pairs of first wheels, and one of each auxiliary wheel of the second pair of first auxiliary wheels in contact with each rail between each of the first and second pairs of first wheels and one wheel of the first pair of first auxiliary wheels.

4. The amusement ride device, comprising:

(a) a track composed of first and second parallel rails and having a central axis extending between the rails, the track including a first straight section, a twist section continuous with the first straight section in which the rails are twisted together at a predetermined angle to the central axis, a second straight section continuous with the twist section and having an overall length at least equal to that of the car, and an arcuate curve section continuous with the second straight section, the respective central axes of the first and second straight sections and the twist section being substantially in line with one another;

(b) a car adapted to travel along the track, the car including a car body having a front end and a rear end, first and second pairs of first wheels and first and second pairs of second wheels, the pairs of wheels adapted to be rotated in contact with the rails, each pair of first wheels being longitudinally spaced from each pair of second wheels along the advancing direction of the car;

(c) supporting means for supporting the first and second pairs of first wheels so that the pairs of first wheels are swingable within a plane perpendicular to the advancing direction of the car, the supporting means including a swinging frame, the pairs of first wheels being rotatably supported on opposed ends thereof, the swinging frame extending substantially at right angles to the advancing direction of the car, the supporting means also including a coupling member for swingably mounting the frame on the car body, the coupling member including a bogie shaft attached to the car body so as to extend in the advancing direction of the car and pivotally support the swinging frame; and (d) retaining means for keeping the pairs of wheels in contact with the rails as the wheels rotate.

5. The amusement ride device according to claim 4, wherein said car body includes a fixed frame having the first and second pairs of second wheels supported individually on two opposite ends thereof for rotation, the fixed frame extending substantially at right angle to the advancing direction of the car.

6. The amusement ride device according to claim 5, wherein said retaining means includes a first pair of second auxiliary wheels rotatably mounted on the fixed frame such that one of each first pair of second auxiliary wheels faces one of each first and second pair of second wheels, each said rail being held between one of each of first and second pairs of second wheels and one wheel of the first pair of second auxiliary wheels.

7. The amusement ride device according to claim 6 wherein said retaining means includes a second pair of second auxiliary wheels rotating mounted on the fixed frame, at right angles to the first and second pairs of second wheels, and one of each auxiliary wheels of the second pair of second auxilary wheels in contact with each rail between each of the first and second pairs of second wheels and one wheel of the first pair of second auxiliary wheels.

8. The amusement ride device according to claim 4, wherein said pair of rails are curved at the curve section so that there is no difference in the radius of curvature between the rails.

9. The amusement ride device according to claim 4, wherein said pair of rails are curved at the curve section so that there is a difference in the radius of curvature between the rails.

10. An amusement ride device, comprising:

(a) a track compared of a pair of second parallel rails and having a central axis extending between the rails, the track including a first straight section, a first twist section continuous with the first straight section in which the rails are twisted together at a predetermined angle to the central axis, a second straight section continuous with the twist section and having an overall length at least equal to that of the car, and an arcuate curve section continuous with the second straight section, the respective central axes of the first and second straight sections and the twist section being substantially in line with one another, the track further including a third straight section continuous with the curve section, a second twist section continuous with the third straight section, said rails being twisted together at a predetermined angle to said central axis, at said second twist section, and a fourth straight section continuous with the second twist section and having an overall length at least equal to that of the car, the respective central axes of said third and fourth straight sections and said second twist section being substantially in line with one another;

(b) a car adapted to travel along the track, the car including a car body having a front end and a rear end, first and second pairs of first wheels and first and second pairs of second wheels, the pairs of wheels adapted to be rotated in contact with the rails each pair of first wheels being longitudinally spaced from each pair of second wheels along the advancing direction of the car;

(c) supporting means for supporting the first and second pairs of first wheels so that the pairs of first wheels are swingable within a plane perpendicular to the advancing direction of the car; and (d) retaining means for keeping the wheels in contact with the rails as the wheels rotate.

11. The amusement ride device according to claim 10, wherein said first and fourth straight sections extend parallel so as to face each other.

12. An amusement ride device, comprising:

(a) a track composed of first and second parallel rails and having a central axis extending between the rails, the track including a first straight section, a twist section continuous with the first straight section in which the rails are twisted together at a predetermined angle to the central axis, a second straight section continuous with the twist section and having an overall length at least equal to that of the car, and an arcuate curve section continuous with the second straight section, the respective central axes of the first and second straight sections and the twist section being substantially in line with one another, wherein said twist section is twisted at about 135°;

(b) a car adapted to travel along the track, the car including a car body having a front end and a rear end, first and second pairs of first wheels and first and second pairs of second wheels, the pairs of wheels adapted to be rotated in contact with the rails, each pair of first whels being longitudinally spaced from each pair of second wheels along the advancing direction of the car;

(c) supporting means for supporting the first and second pairs of first wheels so that the pairs of first wheels are swingable within a plane perpendicular to the advancing direction of the car; and (d) retaining means for keeping the pairs of wheels in contact with the rails as the wheels rotate.

* * * * *